US005334792A

United States Patent [19]

Del Rossi et al.

[11] Patent Number: 5,334,792

[45] Date of Patent: Aug. 2, 1994

[54] COMBINED PARAFFIN ISOMERIZATION/RING OPENING PROCESS FOR C5+NAPHTHA

[75] Inventors: Kenneth J. Del Rossi, Woodbury; David J. Dovedytis, Plainsboro; David J. Esteves, Mercerville, all of N.J.; Mohsen N. Harandi, Langhorne; Albin Huss, Jr., Chadds Ford, both of Pa.

[73] Assignee: Mobil Oil Corporation, Fairfax, Va.

[21] Appl. No.: 958,826

[22] Filed: Oct. 9, 1992

[51] Int. Cl.[5] ..... C07C 5/02; C07C 5/13; C07C 5/23

[52] U.S. Cl. ..... 585/314; 585/315; 585/737; 585/738; 585/739; 585/748; 585/940

[58] Field of Search ..... 585/314, 737, 738, 739, 585/748, 940, 315

[56] References Cited

U.S. PATENT DOCUMENTS

| | | | |
|---|---|---|---|
| 3,244,756 | 4/1966 | Cabbage | 585/737 |
| 3,631,117 | 12/1971 | Kovach et al. | 260/666 |
| 3,759,819 | 9/1973 | Attane et al. | 585/737 |
| 3,923,641 | 12/1975 | Morrison | 208/111 |
| 4,146,462 | 3/1979 | Rustamov et al. | 208/46 |
| 4,162,212 | 7/1979 | Miller | 208/79 |
| 4,175,033 | 11/1979 | Hilfman | 208/143 |
| 4,232,181 | 11/1980 | Kiovsky et al. | 585/739 |
| 4,647,368 | 3/1987 | McGuiness et al. | 208/60 |
| 4,676,887 | 6/1987 | Fischer et al. | 208/61 |
| 4,734,539 | 3/1988 | Lawlor et al. | 585/739 |
| 4,783,575 | 11/1988 | Schmidt et al. | 585/748 |
| 4,804,803 | 2/1989 | Schmidt et al. | 585/748 |
| 4,834,866 | 5/1989 | Schmidt | 208/65 |
| 4,911,823 | 3/1990 | Chen et al. | 208/67 |
| 4,926,000 | 5/1990 | Morrison | 585/476 |
| 4,929,799 | 5/1990 | Holcombe et al. | 585/737 |
| 4,990,239 | 2/1991 | Derr et al. | 208/68 |
| 5,003,118 | 3/1991 | Low et al. | 585/737 |
| 5,055,629 | 10/1991 | Gilson et al. | 585/739 |
| 5,082,988 | 1/1992 | Holtermann | 585/739 |
| 5,095,169 | 3/1992 | Skeels et al. | 585/739 |

*Primary Examiner*—Asok Pal
*Attorney, Agent, or Firm*—Alexander J. McKillop; Dennis P. Santini; Lori F. Cuomo

[57] ABSTRACT

There is provided a process for ring opening of aromatics and cycloaliphatics, as well as isomerization of aliphatics. The feedstream to this process comprises hydrocarbons having 6 carbon atoms. The process involves the use of at least two reactors connected in series. The first reactor contains a zeolite catalyst and is operated under conditions which particularly promote ring opening. The catalyst in this first reactor may comprise zeolite Beta and platinum. A downstream reactor is operated under conditions to promote isomerization of aliphatics. The catalyst in the second reactor may comprise alumina, platinum and a chloride component.

25 Claims, 3 Drawing Sheets

COMBINED PARAFFIN ISOMERIZATION/RING OPENING PROCESS FOR C5+NAPHTHA

CROSS-REFERENCE TO RELATED APPLICATIONS

This application is related by subject matter to Ser. No. 07/783,014, filed Oct. 25, 1991, now abandoned.

BACKGROUND

There is provided a process for ring opening of aromatics and cycloaliphatics, as well as isomerization of aliphatics. The feedstream to this process comprises $C_6$ cycloparaffins and/or benzene. The process involves the use of at least two reactors connected in series. The first reactor comprises a zeolite catalyst and is operated under conditions which particularly promote ring opening. A downstream reactor is operated under conditions to promote isomerization of aliphatics.

A unit process which is frequently encountered in petroleum refining is paraffin isomerization. Paraffin isomerization of linear (straight chain) paraffins produces branched chain paraffins. In such a process, as conventionally operated, low molecular weight $C_{4-C6}$ paraffins are converted to iso-paraffins in the presence of an acidic catalyst such as aluminum chloride. Recently, $C_6$+, preferably $C_{10}$+ n-paraffins, have been isomerized, in the presence of large pore size zeolites to produce branched chain paraffins by skeletal rearrangement. The latter process can find application in dewaxing.

Isomerization is one of several reactions which occur in reforming of naphthas. Reforming of naphthas is undertaken to upgrade a low octane naphtha to a higher octane effluent. One of the octane enhancing reactions which occurs during reforming is the isomerization of n-paraffins to isoparaffins. Under the process conditions of reforming, other reactions which occur are aromatization (or dehydrocyclization), and dehydrogenation, with some cracking.

Paraffin isomerization catalysts may also be employed as ring opening catalysts for removal of aromatics and aromatic precursors from reformer feedstocks. For example, cyclohexane, a precursor to benzene, may be rearranged over commercial paraffin isomerization catalysts to a mixture of branched paraffins. Branched paraffins are only partly aromatized in reforming whereas cyclohexane is almost completely converted to benzene. Application of paraffin isomerization catalysts for ring opening aromatics and aromatic precursors will no doubt become more important as environmental regulations limiting aromatics in gasoline become more stringent.

SUMMARY

The present invention provides a process for integration of a zeolite reactor with an aluminum chloride reactor for the ring opening/isomerization of $C_5$+ naphtha feeds. The process involves feeding a zeolite reactor with a dehexanizer $C_6$ cyclic rich sidestream and recirculated hydrogen. The dehexanizer overhead is then mixed with the zeolite reactor effluent and processed in a paraffin isomerization reactor upstream of the isomerization product recovery section.

The invention therefore includes a process for decreasing the energy consumption and equipment costs of a combined ring opening and isomerization process, said process comprising the steps of:

(a) passing hydrocarbons comprising $C_6$ cyclic hydrocarbons to a fractionation zone;

(b) withdrawing a sidecut comprising $C_6$ hydrocarbons and a majority of said $C_6$ cyclic hydrocarbons entering said fractionation zone;

(c) charging said sidecut along with hydrogen to a first reaction zone, wherein said hydrocarbons and hydrogen are contacted with a catalyst comprising a zeolite and a hydrogenation component under conditions sufficient to saturate benzene and open cyclic hydrocarbons contained in said hydrocarbons;

(d) withdrawing an overhead from said fractionation zone comprising $C_5$ hydrocarbons and a minority of said $C_6$ cyclic hydrocarbons entering said fractionation zone; and (e) mixing said overhead with hydrocarbon product from said first reaction zone and charging to a second reaction zone, wherein hydrocarbons are contacted with an isomerization catalyst under conditions sufficient to isomerize paraffins.

There is also provided a process for ring opening and isomerization of hydrocarbons, said process comprising the steps of:

(a) passing hydrocarbons comprising $C_6$ cyclic hydrocarbons to a fractionation zone;

(b) withdrawing a sidecut comprising $C_6$ hydrocarbons and a majority of said $C_6$ cyclic hydrocarbons entering said fractionation zone;

(c) charging said sidecut along with hydrogen to a first reaction zone, wherein said hydrocarbons and hydrogen are contacted with a catalyst comprising a zeolite and a hydrogenation component under conditions sufficient to saturate benzene and open cyclic hydrocarbons contained in said hydrocarbons;

(d) withdrawing an overhead from said fractionation zone comprising $C_5$ hydrocarbons and a minority of said $C_6$ cyclic hydrocarbons entering said fractionation zone;

(e) mixing said overhead with hydrocarbon product from said first reaction zone and charging to a second reaction zone, wherein hydrocarbons are contacted with an isomerization catalyst under conditions sufficient to isomerize paraffins;

(f) removing hydrogen from effluent of said second reaction zone and recycling to said first reaction zone; and (g) recovering a third stream from said fractionation zone comprising $C_7$ hydrocarbons.

EMBODIMENTS

Figure 1:
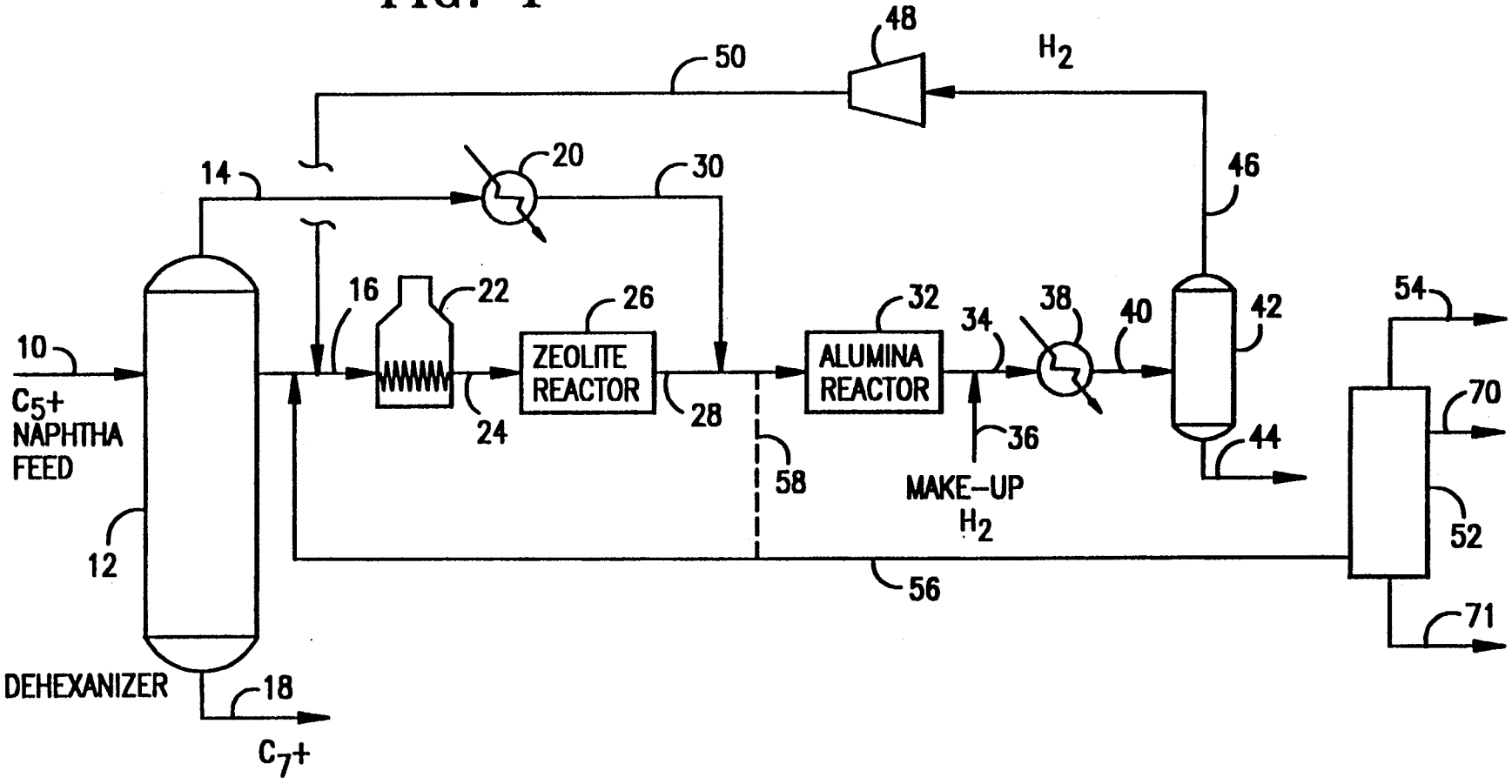
FIGS. 1, 2A and 2B provide schematic representations of embodiments of the present process.

The present inventive process integrates a ring opening reactor and an isomerization unit to lower the equipment cost and reduce utilities consumption. By reducing the feed to the zeolite reactor a single circulation system comprising one flash drum and one compressor can be utilized to supply hydrogen to both reactors. Makeup hydrogen supplements the recycle hydrogen which is sent to the zeolite reactor via a single compressor.

The feed to the zeolite reactor is reduced preferably by about 50 vol%. The feed reduction to the zeolite reactor is dependent on the placement of the $C_5$+ hydrocarbon recycle stream. The operating conditions of the dehexanizer may be adjusted by those skilled in the art with only minimal trial and error to achieve the desired degree of fractionation.

The catalytic ring opening/isomerization process described herein is operated to ring open $C_6$ cyclic hydrocarbons and isomerize the acyclic products together with n-paraffins and mono-methyl branched paraffins to produce a high octane stream.

In the present ring opening/isomerization process n-paraffinic and mono-methyl branched paraffinic components are isomerized to higher branched paraffins which are generally better octane boosters. By way of illustration, the significance of these reactions can be gleaned from a review of the following table of Octane Numbers of Pure Hydrocarbons from P. H. Emmett, ed., *Catalysis,* Vol. VI (1958):

| Octane Numbers of Pure Hydrocarbons | |
|---|---|
| Hydrocarbon | Blending Research Octane Number (clear) |
| Paraffins: | |
| n-heptane | 0 |
| 2-methylhexane | 41 |
| 3-methylhexane | 56 |
| 2,2-dimethylpentane | 89 |
| 2,3-dimethylpentane | 87 |
| 2,2,3-trimethylbutane | 113 |

The feedstock for the present process is one which contains significant amounts of $C_5$+ normal and/or slightly branched paraffins. In addition, the feedstock contains monocyclic aromatic compounds and/or cyclic paraffins, such as cyclohexane. Among the hydrocarbons having 6 or less carbon atoms in the feedstock, at least 1 wt. %, e.g., at least 5 wt. %, e.g., at least 10 wt. %, e.g., at least 20 wt. %, e.g., at least 30 wt. %, of these hydrocarbons may be cyclic hydrocarbons, e.g., aromatics or cyclic paraffins.

The catalyst composition employed in the first reaction zone comprises a dehydrogenation/hydrogenation metal and a zeolite.

The zeolite is to be used in intimate combination with a dehydrogenation/hydrogenation component such as tungsten, vanadium, molybdenum, rhenium, nickel, cobalt, chromium, manganese, or a noble metal such as platinum, palladium or iridium. Such component can be introduced in the catalyst composition to the extent that a Group IIIA element, e.g., aluminum, is in the structure, impregnated therein or intimately physically admixed therewith. Such component can be impregnated in, or on, the zeolite such as, for example, by, in the case of platinum, treating the zeolite with a solution containing a platinum metal-containing ion. Thus, suitable platinum compounds for this purpose include chloroplatinic acid, platinous chloride and various compounds containing the platinum amine complex. The amount of the dehydrogenation/hydrogenation component in the catalyst composition can range from 0.01 to 20 weight percent of the composition.

A convenient measure of the extent to which a zeolite provides control of access to molecules of varying sizes to its internal structure is the Constraint Index of the zeolite. Zeolites which provide a highly restricted access to and egress from its internal structure have a high value for the Constraint Index, and zeolites of this kind usually have pores of small size, e.g., less than 5 Angstoms. On the other hand, zeolites which provide relatively free access to the internal zeolite structure have a low value for the Constraint Index, and usually pores of large size, e.g., greater than 8 Angstroms. The method by which Constraint Index is determined is described fully in U.S. Pat. No. 4,016,218, incorporated herein by reference for details of the method.

The zeolite of the first reaction zone may be a medium or large pore size zeolite. This zeolite may have a Constraint Index of 12 or less. Zeolites having a Constraint Index of 2–12 are generally regarded to be medium pore size zeolites. Zeolites having a Constraint Index of less than 1 are generally regarded to be large pore size zeolites. Zeolites having a Constraint Index of 1–2 may be regarded as either medium or large pore size zeolites.

The members of the class of medium pore size zeolites may have an effective pore size of generally from about 5 to about 8 Angstroms, such as to freely sorb normal hexane. In addition, the structures provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross-section than normal hexane is excluded and the zeolite is not of the medium pore size type. Windows of 10-membered rings are preferred, although, in some instances, excessive puckering of the rings or pore blockage may render these zeolites ineffective.

Although 12-membered rings in theory would not offer sufficient constraint to constitute a medium size pore, it is noted that the puckered 12-ring structure of TMA offretite does show some constrained access. Other 12-ring structures may exist which may be regarded to be medium pore sized, and therefore, it is not the present intention to classify a particular zeolite solely from theoretical structural considerations.

| Constraint Index (CI) values for some typical materials are: | | |
|---|---|---|
| | CI (at test temperature) | |
| ZSM-4 | 0.5 | (316° C.) |
| ZSM-5 | 6–8.3 | (371° C.–316° C.) |
| ZSM-11 | 5–8.7 | (371° C.–316° C.) |
| ZSM-12 | 2.3 | (316° C.) |
| ZSM-20 | 0.5 | (371° C.) |
| ZSM-22 | 7.3 | (427° C.) |
| ZSM-23 | 9.1 | (427° C.) |
| ZSM-34 | 50 | (371° C.) |
| ZSM-35 | 4.5 | (454° C.) |
| ZSM-38 | 2 | (510° C.) |
| ZSM-48 | 3.5 | (538° C.) |
| ZSM-50 | 2.1 | (427° C.) |
| TMA Offretite | 3.7 | (316° C.) |
| TEA Mordenite | 0.4 | (316° C.) |
| Mordenite | 0.5 | (316° C.) |
| Clinoptilolite | 3.4 | (510° C.) |
| Mordenite | 0.5 | (316° C.) |
| REY | 0.4 | (316° C.) |
| Amorphous Silica-alumina | 0.6 | (538° C.) |
| Dealuminized Y (Deal Y) | 0.5 | (510° C.) |
| Erionite | 38 | (316° C.) |
| Zeolite Beta | 0.6–2.0 | (316° C.–399° C.) |

The above-described Constraint Index provides a definition of those zeolites which are particularly useful in the present process. The very nature of this parameter and the recited technique by which it is determined, however, admit of the possibility that a give zeolite can be tested under somewhat different conditions and thereby exhibit different Constraint Indices. Constraint Index seems to vary somewhat with severity of operations (conversion) and the presence or absence of binders. Likewise, other variables, such as crystal size of the zeolite, the presence of occluded contaminants, etc., may affect the Constraint Index. Therefore, it will be appreciated that it may be possible to so select test conditions, e.g., temperature, as to establish more than one value for the Constraint Index of a particular zeolite. This explains the range of Constraint Indices for some zeolites, such as ZSM-5, ZSM-11 and Beta.

It is to be realized that the above CI values typically characterize the specified zeolites, but that such are the cumulative result of several variables useful in the determination and calculation thereof. Thus, for a given zeolite exhibiting a CI value within the range of 1 to 12, depending on the temperature employed during the test method within the range of 290° C. to about 538° C., with accompanying conversion between 10% and 60%, the CI may vary within the indicated range of 1 to 12. Likewise, other variables such as the crystal size of the zeolite, the presence of possibly occluded contaminants and binders intimately combined with the zeolite may affect the CI. It will accordingly be understood to those skilled in the art that the CI, as utilized herein, while affording a highly useful means for characterizing the zeolites of interest is approximate, taking into consideration the manner of its determination, with the possibility, in some instances, of compounding variable extremes. However, in all instances, at a temperature within the above-specified range of 290° C to about 538° C, the CI will have a value for any given zeolite of particular interest herein of 12 or less.

Examples of zeolites having a Constraint Index of from 1 to 12 include ZSM-5, ZSM-11, ZSM-12, ZSM--22, ZSM--23, ZSM-35, ZSM--38 and ZSM-48.

ZSM-5 is described in greater detail in U.S. Pat. Nos. 3,702,886 and Re. 29,948. The entire descriptions contained within those patents, particularly the X-ray diffraction pattern of therein disclosed ZSM-5, are incorporated herein by reference.

ZSM-11 is described in greater detail in U.S. Pat. No. 3,709,979. That description, and in particular the X-ray diffraction pattern of said ZSM-11, is incorporated herein by reference.

ZSM-12 is described in U.S. Pat. No. 3,832,449. That description, and in particular the X-ray diffraction pattern disclosed therein, is incorporated herein by reference.

ZSM-22 is described in U.S. Pat. No. 4,556,477, the entire contents of which is incorporated herein by reference.

ZSM-23 is described in U.S. Pat. No. 4,076,842. The entire content thereof, particularly the specification of the X-ray diffraction pattern of the disclosed zeolite, is incorporated herein by reference.

ZSM-35 is described in U.S. Pat. No. 4,016,245. The description of that zeolite, and particularly the X-ray diffraction pattern thereof, is incorporated herein by reference.

ZSM-38 is more particularly described in U.S. Pat. No. 4,406,859. The description of that zeolite, and particularly the specified X-ray diffraction pattern thereof, is incorporated herein by reference.

ZSM-48 is more particularly described in U.S. Pat. No. 4,234,231, the entire contents of which is incorporated herein by reference.

The large pore zeolites, including those zeolites having a Constraint Index less than 2, are well known to the art and have a pore size sufficiently large to admit the vast majority of components normally found in a feed chargestock. The zeolites are generally stated to have a pore size in excess of 7 Angsttoms and are represented by zeolites having the structure of, e.g., Zeolite Beta, Zeolite Y, Ultrastable Y (USY), Dealuminized Y (Deal Y), Mordenite, ZSM-3, ZSM--4, ZSM--18 and ZSM-20. A crystalline silicate zeolite well known in the art and useful in the present invention is faujasite. The ZSM-20 zeolite resembles faujasite in certain aspects of structure, but has a notably higher silica/alumina ratio than faujasite, as does Deal Y.

Although Zeolite Beta has a Constraint Index less than 2, it is to be noted that it does not have the same structure as the other large pore zeolites, nor does it behave exactly like a large pore zeolite. However, Zeolite Beta is a particularly preferred zeolite for use in the present first reaction zone.

Zeolite ZSM-14 is described in U.S. Pat. No. 3,923,636, to which reference is made for details of this catalyst.

Zeolite ZSM-20 is described in U.S. Pat. No. 3,972,983, to which reference is made for details of this catalyst.

Zeolite Beta is described in U.S. Pat. Nos. 3,308,069, and Re. No. 28,341, to which reference is made for details of this catalyst.

Low sodium Ultrastable Y molecular sieve (USY) is described in U.S. Pat. Nos. 3,293,192 and 3,449,070, to which reference is made for details of this catalyst.

Dealuminized Y zeolite (Deal Y) may be prepared by the method found in U.S. Pat. No. 3,442,795, to which reference is made for details of this catalyst.

Zeolite UHP-Y is described in U.S. Pat. No. 4,401,556, to which reference is made for details of this catalyst.

Another zeolite which may be used in the present first reaction zone is MCM-22. MCM--22 is described in U.S. Pat. No. 4,954,325, as well as in copending U.S. application Ser. No. 07/663,758, filed Mar. 1, 1991, the entire disclosures of which are expressly incorporated herein by reference.

Zeolites with intersecting pore systems, such as Zeolite Beta and Zeolite Y, are of particular interest in the present process.

The zeolite crystals can be shaped into a wide variety of particle sizes. Generally speaking, the particles can be in the form of a powder, a granule, or a molded product such as an extrudate having a particle size sufficient to pass through a 2 mesh (Tyler) screen and be retained on a 400 mesh (Tyler) screen. In cases where the catalyst is molded, such as by extrusion, the crystals can be extruded before drying or partially dried and then extruded.

It may be desired to incorporate the zeolite with another material which is resistant to the temperatures and other conditions employed in the present process. Such materials include active and inactive materials and synthetic or naturally occurring zeolites as well as inorganic materials such as clays, silica and/or metal oxides such as alumina. The latter may be either naturally occurring or in the form of gelatinous precipitates or gels including mixtures of silica and metal oxides. Use of a material in conjunction with the zeolite, i.e., combined therewith or present during its synthesis, which itself is catalytically active may change the conversion and/or selectivity of the catalyst. Inactive materials suitably serve as diluents to control the amount of conversion so that products can be obtained economically and orderly without employing other means for controlling the rate of reaction. These materials may be incorporated into naturally occurring clays, e.g., bentonite and kaolin, to improve the crush strength of the catalyst under commercial operating conditions. Said materials, i.e., clays, oxides, etc., function as binders for the catalyst. It is desirable to provide a catalyst having good crush strength because in commercial use, it is desirable to prevent the catalyst from breaking down into powder-like materials. These clay binders have been employed normally only for the purpose of improving the crush strength of the catalyst.

Naturally occurring clays which can be composited with zeolite crystals include the montmorillonite and kaolin family, which families include the subbentonites, and the kaolins commonly known as Dixie, McNamee, Georgia and Florida clays or others in which the main mineral constituent is halloysite, kaolinite, dickite, nacrite, or anauxite. Such clays can be used in the raw state as originally mined or initially subjected to calcination, acid treatment or chemical modification. Binders useful for compositing with the zeolite also include inorganic oxides, notably alumina.

In addition to the foregoing materials, the crystals can be composited with a porous matrix material such as silica-alumina, silica-magnesia, silica-zirconia, silica-thoria, silica-beryllia, silica-titania as well as ternary compositions such as silica-alumina-thoria, silica-alumina-zirconia, silica-alumina-magnesia and silica-magnesia-zirconia. It may also be advantageous to provide at least a part of the foregoing matrix materials in colloidal form so as to facilitate extrusion of the bound catalyst component(s).

The relative proportions of finely divided crystalline material and inorganic oxide matrix vary widely, with the crystal content ranging from about 1 to about 90 percent by weight and more usually, particularly when the composite is prepared in the form of beads, in the range of about 2 to about 80 weight percent of the composite.

In the first reaction zone, the temperature should be high enough to promote substantial ring opening without causing excessive cracking of hydrocarbons to $C_4$-hydrocarbons. This reaction temperature may be at least 150° C., e.g., from 230° C. to 270° C. Pressures range from atmospheric up to 1500 psig. The preferred range is from 200 to 1200 psig. Weight hourly space velocity is generally from 0.1 to 50 $hr^{-1}$, more usually 0 2 to 10 $hr^{-1}$. The hydrogen:hydrocarbon molar ratio in the charge stock to the first reaction zone is generally from 0.1:1 to 10:1. The reaction conditions in the first reaction zone may be sufficient to cause at least 10 wt. %, e.g., at least 25 wt. %, e.g., at least 50 wt. %, of the cyclic hydrocarbons introduced into this zone to undergo ring opening.

The reaction conditions in the second reaction zone may be milder, particularly in terms of lower temperature conditions, to optimize isomerization of paraffins to higher octane value isomers. The temperature in the second reaction zone is generally lower than about 270° C. The theoretical equilibrium concentration of high octane isomers, such as 2,2-dimethylbutane, increases with lower temperature conditions. Thus, high yields of desirable high octane isomers are achievable at lower temperature conditions.

In order to use lower temperatures in the second reaction zone, it is preferred to use a catalyst which is more active for isomerization than the zeolite-containing catalyst used in the first reaction zone. Examples of such more reactive catalysts, which may be used in the second reaction zone, include those catalysts described in U.S. Pat. Nos. 4,783,575; 4,804,803; and 4,834,866, the entire disclosures of which are expressly incorporated herein by reference. These catalysts comprise alumina, platinum and a chloride component.

The isomerization catalyst in the second reaction zone may be a high chloride catalyst on an alumina base containing platinum. The alumina is preferably an anhydrous gamma-alumina with a high degree of purity. The catalyst may also contain other platinum group metals. The term platinum group metals refers to noble metals excluding silver and gold which are selected from the group consisting of platinum, palladium, germanium, ruthenium, rhodium, osmium, and iridium. These metals demonstrate differences in activity and selectivity such that platinum has now been found to be the most suitable for this process. The catalyst may contain at least about 0.1 wt. %, e.g., from about 0.1 to about 1.0 wt. %, e.g., from about 0.1 to 0.25 wt. %, of platinum. Other platinum group metals may be present in a concentration of at least about 0.1 wt. %, e.g., from about 0.1 to 1.0 wt. %, e.g., from 0.1 to 0.25 wt. %. The platinum component may exist within the final catalytic composite as an oxide or halide or as an elemental metal. The presence of the platinum component in its reduced state has been found most suitable for this process.

The catalyst of the second reaction zone may also contain a chloride component. The chloride component termed in the art "a combined chloride" may be present in an amount of at least about 2 wt. %, e.g., from about 2 to about 20 wt. %, e.g., from about 2 to about 10 wt. %, based upon the dry support material. The use of chloride in amounts greater than 5 wt. % have been found to be the most beneficial for this process.

There are a variety of ways for preparing this catalytic composite and incorporating the platinum metal and the chloride therein. One method prepares the catalyst by impregnating the carrier material through contact with an aqueous solution of a water-soluble decomposable compound of the platinum group metal. For best results, the impregnation is carried out by dipping the carrier material in a solution of chloroplatinic acid. Additional solutions that may be used include ammonium chloroplatinate, bromoplatinic acid or platinum dichloride. Use of the platinum chloride compound serves the dual function of incorporating the platinum component and at least a minor quantity of the chloride into the catalyst. Additional amounts of the chloride must be incorporated into the catalyst by the addition or formation of aluminum chloride to or on the platinum-aluminum catalyst base. An alternate method of increasing the chloride concentration in the final catalyst composite is to use an aluminum hydrosol to form the aluminum carrier material such that the carrier material also contains at least a portion of the chloride. Halogen may also be added to the carrier material by contacting the calcined carrier material with an aqueous solution of the halogen acid such as hydrogen chloride.

It is generally known that high chlorided platinum-alumina catalysts of this type are highly sensitive to sulfur and oxygen-containing compounds. Therefore, the feedstock contacting this catalyst must be relatively free of such compounds. A sulfur concentration no greater than 0.5 ppm is generally required. The presence of sulfur in the feedstock serves to temporarily deactivate the catalyst by platinum poisoning. Activity of the catalyst may be restored by hot hydrogen stripping of sulfur from the catalyst composite or by lowering the sulfur concentration in the incoming feed to below 0.5 ppm so that the hydrocarbon will desorb the sulfur that has been adsorbed on the catalyst. Water can act to permanently deactivate the catalyst by removing high activity chloride from the catalyst and replacing it with inactive aluminum hydroxide. Therefore, water, as well as oxygenates, in particular $C_{1-C5}$oxygenates, that can decompose to form water, can only be tolerated in very low concentrations. In general, this requires a limitation of oxygenates in the feed to about 0.1 ppm or less. The feedstock may be treated by any method that will remove water and sulfur compounds. Sulfur may be removed from the feedstream by hydrotreating. A variety of commercial dryers are available to remove water from the feed components. Adsorption processes for the removal of sulfur and water from hydrocarbon streams are also well known to those skilled in the art.

It has been recognized that cyclic hydrocarbons, especially $C_6$ cyclics such as benzene, cyclohexane and methylcyclopentane adversely affect the degree of paraffin isomerization over this particular type of alumina/platinum/chloride catalyst. The adverse effect is believed to be caused by preferential adsorption of the cyclic hydrocarbons on the catalyst surface and the resulting exclusion of the paraffinic hydrocarbons. However, the adverse effect is minimized by substantially removing cyclics in the first reaction zone. Operating conditions within the second reaction zone are selected to maximize the production of isoalkane product from the feed components. The temperature within the reaction zone will normally be less than 230° C. and will usually range from about 40 ° C. to 180° C. Lower reaction temperatures are preferred for purposes of isomerization conversion since they favor isoalkanes over normal alkanes in equilibrium mixtures.

The hydrogen to hydrocarbon molar ratio in the second reaction zone may be from 0.01 to 10, e.g., from 0.01 to 5. However, it is noted that the primary reaction, i.e., isomerization, which takes place in this zone, does not consume net hydrogen. Furthermore, the types of side reactions, e.g., saturation of olefins and aromatics, which consume hydrogen, take place primarily in the first reaction zone. Accordingly, the hydrogen to hydrocarbon molar ratio in the second reaction zone may be quite small, e.g., 0.05 or less.

The pressure in the second reaction zone may be maintained over a wide range of pressures. Pressure conditions range from 50 to 1500 psig. The feed rate to the second reaction zone can also vary over a wide range. These conditions include weight hourly space velocities ranging from 0.1 to 50 $hr^{-1}$, however, space velocities between 0.5 and 3 hr. $^{-1}$ are preferred.

When the above-mentioned alumina/platinum/chloride catalyst is used, operation of the second reaction zone also requires the presence of a small amount of an organic chloride promoter. The organic chloride promoter sees to maintain a high level of active chloride on the catalyst as small amounts of chloride are continuously stripped off the catalyst by the hydrocarbon feed. The concentration of promoter in the reaction zone is maintained at from 30 to 300 ppm. The preferred promoter compound is carbon tetrachloride. Other suitable promoter compounds include oxygen-free decomposable organic chlorides such as propyldichloride, butylchloride, and chloroform to name only a few of such compounds. The need to keep the reactants dry is reinforced by the presence of the organic chloride compound which may convert, in part, to hydrogen chloride. As long as the process streams are kept dry, there will be no adverse effect from the presence of small amounts of hydrogen chloride.

More than one reactor may be employed in each of the above-mentioned reaction zones. The use of two reactors permits a variation in the operating conditions between the two reactors to enhance cyclic hydrocarbon conversion in the first reactor. In this manner, the first reactor operates at higher temperature and pressure conditions that favor ring opening. The likelihood of exothermic reactions, such as the hydrogenation of unsaturates, occurring in the initial portion of the reaction zone facilitates the use of higher temperatures therein. Once the rings have been opened, the final reactor stage may operate at temperature conditions that are more favorable for isoalkane equilibrium.

Another benefit of using two reactors is that it allows partial replacement of the catalyst system without taking the isomerization unit off stream. For short periods of time, during which the replacement of catalyst may be necessary, the entire flow of reactants may be processed through only one reaction vessel while catalyst is replaced in the other.

After the feedstock has encountered the second reaction zone, the effluent of the process will enter separation facilities in the recovery of an isoalkane product. At minimum, the separation facilities divide the reaction zone effluent into a product stream comprising $C_4$ and heavier hydrocarbons and a gas stream which is made up of lighter hydrocarbons and hydrogen. Suitable designs for rectification columns and separator vessels are well known to those skilled in the art. The separation section may also include facilities for recovery of normal alkanes. Normal alkanes recovered from the separation facilities may be recycled to the isomerization reaction zone to increase the conversion of normal alkanes to isoalkanes. Typical separation facilities will comprise a stabilizer section that receives the effluent from the reaction and includes at least one stabilizer column. The stabilizer column is operated to deliver a bottoms fraction containing $C_4$ and heavier hydrocarbons and an overhead fraction of $C_3$ hydrocarbons and lighter boiling compounds. The heavier hydrocarbons recovered from the bottom of the stabilizer column are cooled and may be further separated into a product stream and a reflux stream. $C_3$ and lighter hydrocarbons taken overhead from the stabilizer column are cooled, condensed and separated into a reflux stream that is returned to the process and a wet gas stream. The wet gas stream enters a scrubber section that contacts the gas with a suitable treatment solution for neutralizing and/or removing acidic components that may have originated with the chloride addition to the isomerization zone and may by present in the gas stream.

FIG. 1 provides a schematic representation of an embodiment of the present process. Elements common in FIGS. 1, 2A and 2B have the same reference numerals. $C_5$+ naphtha enters through line 10 to dehexanizer 12. The $C_5$+ naphtha is separated into three fractions: $C_5$ paraffins (i.e., n-pentane, cyclopentane) which are concentrated overhead line 14; $C_6$paraffins (i.e., n-hexane, 2-methylpentane), cycloparaffins (i.e., cyclohexane), and isoparaffins (i.e., 2,2-dimethylbutane) which are concentrated in sidedraw line 16; and $C_7$+ hydrocarbons which are sent via line 18 to a reformer.

The $C_6$ sidecut is mixed with hydrogen stream 50 and preheated in furnace 22 and passed via line 24 to reactor 26. The molar ratio of hydrogen to hydrocarbon in the mixed feed can range from about 10/1 to 0.01/1. Reactor 26 contains a high activity, noble metal containing zeolite. Reactor 26 pressure can range from 50–1500 psig, preferably about 435 psig. $C_5$+ feed rates can vary from about 0.1 to 10 LHSV. The low octane paraffins and cycloparaffins in the $C_6$ cut are partially converted to isoparaffins in reactor 26. The overhead material is cooled through heat exchanger 20 and mixed with reactor effluent 28 via line 30 prior to entering isomerization reactor 32.

Reactor 32 contains an amorphous, chlorided alumina catalyst. Reactor 32 pressure can range from 50–1500 psig, preferably about 420 psig. Feed rates can vary from about 0.1 to 10 LHSV. A small amount of organic chloride (10–500 ppm Cl on total feed) is injected into the feed prior to reactor 32. Organic chlorides, such as carbon tetrachloride, are needed to maintain isomerization activity of chlorided alumina catalysts. The total effluent from reactor 32 is cooled through heat exchanger 38 via line 34 and passed to liquid-gas separator 42 via line 40. Makeup hydrogen gas which supplements the recycle hydrogen gas is mixed with total effluent from reactor 32 via line 36 prior to entering heat exchanger 38. Hydrogen gas from the separator is recycled via line 46 through compressor 48 and line 50 to reactor 26. Recycle gas is a mixture of $C_4$−hydrocarbons, hydrogen and chloride promoter. Optionally, makeup hydrogen gas may be added, additionally or alternatively to the recycle stream prior to or following compressor 48.

$C_6$ paraffins and cycloparaffins are partially converted to isoparaffins in Reactor 32. The liquid component in the gas-liquid separator is sent via line 44 to distillation column 52. Low octane unconverted $C_6$ hydrocarbons are removed as a side draw from the column and recycled via line 56 where unconverted $C_6$ paraffins and cycloparaffins are reacted by recycling through line 16 to zeolite reactor 26. Optionally, $C_5$+ hydrocarbons may be recycled, additionally or alternatively, to the inlet of alumina reactor 32 via line 58. Normally gaseous compounds which are soluble in the liquid from the gas-liquid separator 42 ($H_2$, chloride promoter, $C_4$-hydrocarbons) are concentrated at the top of distillation column 52 and piped to a caustic scrubber and/or isobutane recovery facility via line 54. The $C_5$-$C_6$ rich product is removed via stream 70 and $C_7$ rich product stream is removed from the bottom of the column via stream 71.

Figure 2A:
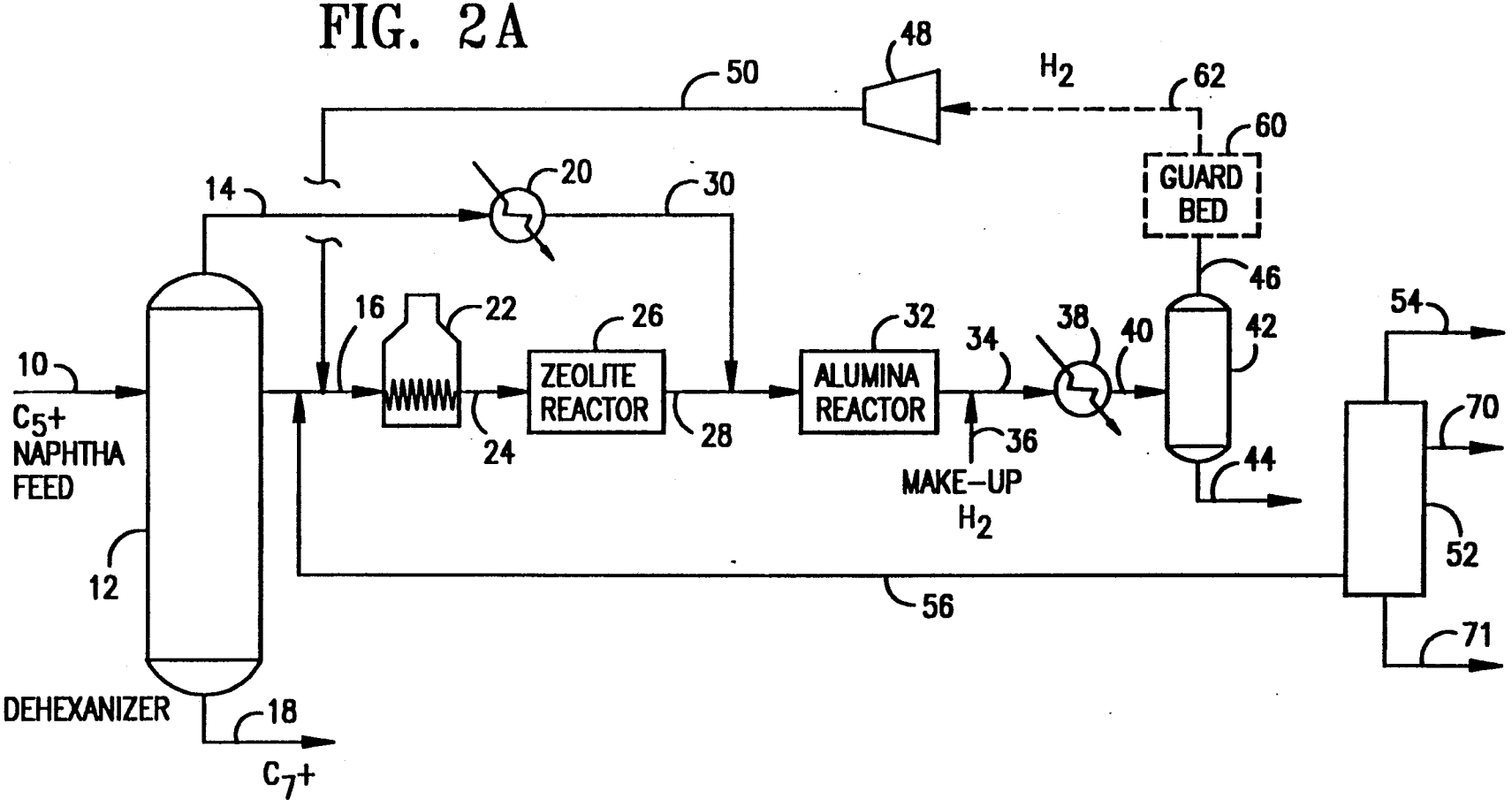
Figure 2B:
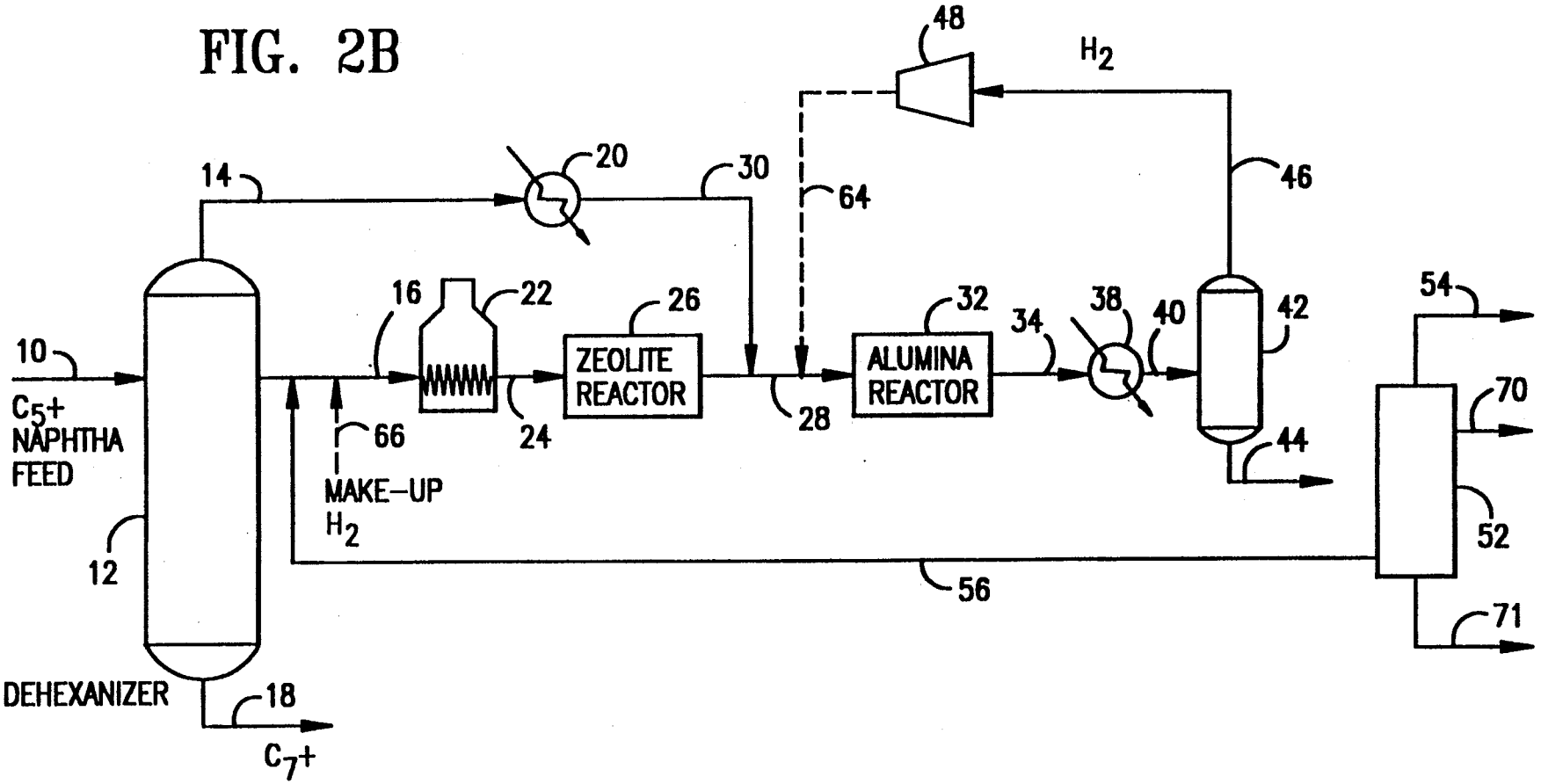

If the level of chlorides present in the recycle hydrogen stream proves to be deleterious to the zeolite catalyst in reactor 26, a guard bed 60 can be used to remove harmful levels of chlorides from the recycle hydrogen stream prior to passing through compressor 48 via line 62, as shown in FIG. 2A. In FIG. 2B, the recycle hydrogen is sent via line 64 to the chlorided alumina reactor while contaminant free makeup hydrogen supplies the zeolite reactor via line 66.

The process of the present invention results in a reduction of equipment costs. The amount of dehexanizer overhead cooling can be used to control the temperature of the isomerization reactor feed, thereby eliminating the need for a heat exchanger. Decreasing the volume of feed to the zeolite reactor also results in a utility savings. The zeolite reactor feed preheating and effluent cooling requirements will both be less.

The following example illustrates the process of the present invention.

EXAMPLE 1

Ring opening/isomerization is carried out in accordance with the process of the present invention as shown in FIG. 1 using a fresh $C_5$+ naphtha feed to dehexanizer 10. The reaction conditions and feedstock composition are shown in Table 1.

TABLE 1

| Component, Vol. % | | |
|---|---|---|
| Iso-Butane | $5.73 \times 10^{-4}$ | |
| N-Butane | $2.48 \times 10^{-3}$ | |
| Iso-Pentane | 0.56 | |
| N-Pentane | 0.72 | |
| Cyclopentane | 0.00 | |
| 2,2-Dimethyl-Butane | 1.14 | |
| 2,3-Dimethyl-Butane | 0.32 | |
| 2-Methyl-Pentane | 2.91 | |
| 3-Methyl-Pentane | 1.82 | |
| N-Hexane | 5.56 | |
| Methyl-Clyclo-$C_5$ | 3.86 | |
| Benzene | 2.55 | |
| Cyclohexane | 6.61 | |
| $C_7$+ | 74.95 | |
| Reaction Conditions | Ring Opening | Isomerization |
| LHSV, $hr^{-1}$ | 1.0 | 1.2 |
| $H_2$/hydrocarbon (mol/mol) | 2:1 | 1:1 |
| Pressure, psig | 435 | 420 |
| Inlet temperature, °F. | 510 | 340 |

The dehexanizer overhead 14 and sidestream 16 have the following compositions as set forth in Table 2:

TABLE 2

| Component, Vol. % | Overhead | Sidestream |
|---|---|---|
| Iso-Butane | 0.01 | 0.00 |
| N-Butane | 0.04 | 0.00 |
| Iso-Pentane | 7.07 | 0.94 |
| N-Pentane | 7.81 | 1.51 |
| Cyclopentane | 0.00 | 0.00 |
| 2,2-Dimethyl-Butane | 1.06 | 0.41 |
| 2,3-Dimethyl-Butane | 1.83 | 1.09 |
| 2-Methyl-Pentane | 16.08 | 10.18 |
| 3-Methyl-Pentane | 8.75 | 6.70 |
| N-Hexane | 22.17 | 21.73 |
| Methyl-Cyclo-$C_5$ | 12.61 | 15.78 |
| Benzene | 7.02 | 10.76 |
| Cyclohexane | 14.54 | 27.83 |
| $C_7$+ | 1.01 | 3.08 |

Properties and yields of the isomerization reactor effluent in this example are based upon approximately a 5000 BPD (barrels per day) $C_6$ sidecut as feed to zeolite reactor 26, and are presented in the following Table 3:

TABLE 3

| Component, Wt % | |
|---|---|
| $C_3$− | 2.58 |
| Iso-Butane | 5.29 |
| N-Butane | 2.49 |
| Iso-Pentane | 18.94 |
| N-Pentane | 7.73 |
| Cyclopentane | 0.71 |
| 2,2-Dimethyl-Butane | 19.66 |
| 2,3-Dimethyl-Butane | 6.93 |
| 2-Methyl-Pentane | 16.56 |
| 3-Methyl-Pentane | 6.95 |
| N-Hexane | 2.64 |
| $C_6$ Cyclics | 4.09 |
| $C_7$+ | 5.43 |
| Total | 100 |
| Properties of $C_5$+ Fraction: | |
| Total Wt. % | 89.6 |
| Specific Gravity | 0.656 |

TABLE 3-continued

| | |
|---|---|
| Lbs/hr | 71,450 |
| Bbl/hr | 311.2 |
| Est. RON | 83.5 |
| Octane BBls | 26,000 |

EXAMPLE 2

The reaction conditions, feedstock composition and dehexanizer overhead and sidestream compositions are the same as set forth in Example 1.

Properties and yields of the isomerization reactor effluent in this example are based upon approximately a 2000 BPD (barrels per day) $C_6$ sidecut and a $C_5$+ hydrocarbon recycle (4300 BPD) as feed to zeolite reactor 26 and are presented in the following Table 4:

TABLE 4

| | |
|---|---|
| Component, Wt % | |
| $C_3$− | 3.29 |
| Iso-Butane | 5.07 |
| N-Butane | 2.39 |
| Iso-Pentane | 18.04 |
| N-Pentane | 7.37 |
| Cyclopentane | 0.71 |
| 2,2-Dimethyl-Butane | 18.86 |
| 2,3-Dimethyl-Butane | 7.01 |
| 2-Methyl-Pentane | 17.01 |
| 3-Methyl-Pentane | 7.05 |
| N-Hexane | 2.11 |
| $C_6$ Cyclics | 5.71 |
| $C_7$ + | 5.38 |
| Total | 100 |
| Properties of $C_5$+ Fraction: | |
| Total Wt. % | 89.3 |
| Specific Gravity | 0.658 |
| Lbs/hr | 71,100 |
| Bbl/hr | 308.7 |
| Est. RON | 83.7 |
| Octane BBls | 25,850 |

Changes and modifications in the specification can be carried out without departing from the scope of the invention which is intended to be limited only by the scope of the appended claims.

What is claimed is:

1. A process for ring opening and isomerization of $C_5$+ naphtha hydrocarbons, said process comprising the steps of:

(a) passing $C_5$+ naphtha hydrocarbons comprising at least 10 wt. % $C_6$ cyclic hydrocarbons to a fractionation zone;

(b) withdrawing a sidecut comprising $C_6$ hydrocarbons and a majority of said $C_6$ cyclic hydrocarbons entering said fractionation zone;

(c) charging said sidecut along with hydrogen to a first reaction zone, wherein said hydrocarbons and hydrogen are contacted with a catalyst comprising a zeolite and a hydrogenation component at a temperature and pressure sufficient to saturate benzene and open cyclic hydrocarbons contained in said hydrocarbons;

(d) withdrawing an overhead from said fractionation zone comprising $C_5$ hydrocarbons and a minority of said $C_6$ cyclic hydrocarbons entering said fractionation zone; and (e) mixing said overhead with hydrocarbon product from said first reaction zone and charging to a second reaction zone, wherein hydrocarbons are contacted with an isomerization catalyst at a temperature and pressure sufficient to isomerize paraffins, and wherein said second reaction zone temperature is lower than said first reaction zone temperature.

2. A process according to claim 1, wherein said zeolite is an aluminosilicate zeolite having a Constraint Index of 12 or less.

3. A process according to claim 1, wherein said zeolite is Zeolite Beta.

4. A process according to claim 1, wherein the reaction conditions in the first reaction zone include a temperature of at least 150° C., a pressure of from 50 to 1500 psig and a weight hourly space velocity of from 0.1 to 50 $hr^{-1}$.

5. A process according to claim 4, wherein the reaction conditions in the second reaction zone include a temperature of from about 40° to 180° C., a pressure of from 50 to 1500 psig and a weight hourly space velocity of from 0.1 to 50 $hr^{-1}$.

6. A process according to claim 1, wherein at least 10 wt. % of the cyclic hydrocarbon rings charged into said first reaction zone are opened in step (a).

7. A process according to claim 1, wherein the catalyst in the second reaction zone comprises alumina, from 0.1 to 1.0. wt. % platinum, and from 2 to 20 wt. % of a chloride component.

8. A process according to claim 7, wherein a chloride concentration of from 30 to 300 ppm is maintained in said second reaction zone.

9. A process for ring opening and isomerization of hydrocarbons, said process comprising the steps of:

(a) passing hydrocarbons comprising $C_6$ cyclic hydrocarbons to a fractionation zone;

(b) withdrawing a sidecut comprising $C_6$ hydrocarbons and a majority of said $C_6$ cyclic hydrocarbons entering said fractionation zone;

(c) charging said sidecut along with hydrogen to a first reaction zone, wherein said hydrocarbons and hydrogen are contacted with a catalyst comprising a zeolite and a hydrogenation component at a temperature and pressure sufficient to saturate benzene and open cyclic hydrocarbons contained in said hydrocarbons;

(d) withdrawing an overhead from said fractionation zone comprising $C_5$ hydrocarbons and a minority of said $C_6$ cyclic hydrocarbons entering said fractionation zone;

(e) mixing said overhead with hydrocarbon product from said first reaction zone and charging to a second reaction zone, wherein hydrocarbons are contacted with an isomerization catalyst at a temperature and pressure sufficient to isomerize paraffins, and wherein said second reaction zone temperature is lower than said first reaction zone temperature;

(f) removing hydrogen from effluent of said second reaction zone and recycling to said first reaction zone; and (g) recovering a third stream from said fractionation zone comprising $C_7$ hydrocarbons.

10. A process according to claim 9, wherein said zeolite is an aluminosilicate zeolite having a Constraint Index of 12 or less.

11. A process according to claim 10, wherein said zeolite has an intersecting pore system.

12. A process according to claim 9, wherein said zeolite is Zeolite Beta.

13. A process according to claim 9, wherein said catalyst in the first reaction zone and the catalyst in the second reaction zone each comprise platinum.

14. A process according to claim 9, wherein $C_5$ hydrocarbons are cofed into the reaction zone of step (c).

15. A process according to claim 9, wherein at least 25 wt. % of the cyclic hydrocarbon rings charged into said first reaction zone are opened in step (c).

16. A process according to claim 9, wherein the catalyst in the second reaction zone comprises alumina, from 0.1 to 1.0. wt. % platinum, and from 2 to 20 wt. % of a chloride component.

17. A process according to claim 16, wherein a chloride concentration of from 30 to 300 ppm is maintained in said second reaction zone.

18. A process for ring opening and isomerization of hydrocarbons, said process comprising the steps of:

(a) passing hydrocarbons comprising $C_6$ cyclic hydrocarbons to a fractionation zone;

(b) withdrawing a sidecut comprising $C_6$ hydrocarbons and a majority of said $C_6$ cyclic hydrocarbons entering said fractionation zone;

(c) charging said sidecut along with hydrogen to a first reaction zone, wherein said hydrocarbons and hydrogen are contacted with a catalyst comprising a zeolite and a hydrogenation component at a temperature and pressure sufficient to saturate benzene and open cyclic hydrocarbons contained in said hydrocarbons;

(d) withdrawing an overhead from said fractionation zone comprising $C_5$ hydrocarbons and a minority of said $C_6$ cyclic hydrocarbons entering said fractionation zone;

(e) mixing said overhead with hydrocarbon product from said first reaction zone and charging to a second reaction zone, wherein hydrocarbons are contacted with an isomerization catalyst at a temperature and pressure sufficient to isomerize paraffins, and wherein said second reaction zone temperature is less than about 230° C.;

(f) recovering an effluent from said second reaction zone comprising unconverted $C_5+$ hydrocarbons in a product separation zone and recycling to said second reaction zone;

(g) removing hydrogen from effluent of said second reaction zone and recycling to said first reaction zone; and (h) recovering a third stream from said fractionation zone comprising $C_7$ hydrocarbons.

19. A process according to claim 18, wherein said zeolite has a Constraint Index of 12 or less.

20. A process according to claim 18, wherein said zeolite is Zeolite Y or Zeolite Beta.

21. A process according to claim 18, wherein said zeolite is Zeolite Beta.

22. A process according to claim 18, wherein the catalyst in the second reaction zone comprises alumina, from 0.1 to 1.0. wt. % platinum, and from 2 to 20 wt. % of a chloride component.

23. A process according to claim 22, wherein a chloride concentration of from 30 to 300 ppm is maintained in said second reaction zone.

24. A process according to claim 18, wherein at least 50 wt. % of the cyclic hydrocarbon rings charged into said first reaction zone are opened in step (c).

25. A process according to claim 1, wherein feed to said first reaction zone is reduced by about 50 vol. % in comparison to feed to said fractionation zone.

* * * * *